US011466692B2

(12) United States Patent
Ohtachi et al.

(10) Patent No.: US 11,466,692 B2
(45) Date of Patent: Oct. 11, 2022

(54) ADAPTOR AND VACUUM PUMP

(71) Applicant: Edwards Japan Limited, Chiba (JP)

(72) Inventors: Yoshinobu Ohtachi, Chiba (JP); Yasushi Maejima, Chiba (JP); Tsutomu Takaada, Chiba (JP)

(73) Assignee: Edwards Japan Limited, Chiba (JP)

( * ) Notice: Subject to any disclaimer, the term of this patent is extended or adjusted under 35 U.S.C. 154(b) by 182 days.

(21) Appl. No.: 15/552,137

(22) PCT Filed: Jan. 19, 2016

(86) PCT No.: PCT/JP2016/051421
§ 371 (c)(1),
(2) Date: Aug. 18, 2017

(87) PCT Pub. No.: WO2016/136331
PCT Pub. Date: Sep. 1, 2016

(65) Prior Publication Data

US 2018/0038375 A1 Feb. 8, 2018

(30) Foreign Application Priority Data

Feb. 25, 2015 (JP) ..... JP2015-035437

(51) Int. Cl.
*F04D 19/04* (2006.01)
*F04D 29/64* (2006.01)
(Continued)

(52) U.S. Cl.
CPC ..... *F04D 19/042* (2013.01); *F04C 18/126* (2013.01); *F04D 17/168* (2013.01);
(Continued)

(58) Field of Classification Search
CPC ..... F04D 19/042; F04D 17/168; F04D 29/64; F04D 29/644; F04D 29/083; F04D 19/04;
(Continued)

(56) References Cited

U.S. PATENT DOCUMENTS 3,168,977 A * 2/1965 Henri ..... F04D 19/042 417/423.4
4,806,075 A * 2/1989 Osterstrom ..... F04D 19/042 384/115

(Continued)

FOREIGN PATENT DOCUMENTS

EP 0939228 A1 9/1999
JP S6043197 3/1982

(Continued)

OTHER PUBLICATIONS

European Communication dated Sep. 26, 2018 and Supplementary European Search Report dated Sep. 14, 2018 for corresponding European Application No. EP16755081.

(Continued)

*Primary Examiner* — Philip E Stimpert
(74) *Attorney, Agent, or Firm* — Theodore M. Magee; Westman, Champlin & Koehler, P.A.

(57) ABSTRACT

Provided are a vacuum pump and an adapter used in the vacuum pump that are capable of responding to various changes in specifications at low cost. A turbo-molecular pump includes a base, a stator blade that is provided above the base in an axial direction of a rotor, a rotor blade that is integrally attached to the rotor, a housing that is formed in a cylindrical shape, and accommodates the stator blade and is integrally attached to the base, and an adapter that is replaceable depending on a type of the stator blade, the rotor blade, or the housing, and that is detachably mounted on the base and is configured to support the stator blade in the axial direction.

11 Claims, 7 Drawing Sheets

(51) Int. Cl.

| | |
|---|---|
| ***F04D 29/52*** | (2006.01) |
| ***F04D 17/16*** | (2006.01) |
| ***F04D 29/08*** | (2006.01) |
| ***F04C 18/12*** | (2006.01) |

(52) U.S. Cl.
CPC ..... *F04D 29/522* (2013.01); *F04D 29/64* (2013.01); *F04D 29/644* (2013.01); *F04D 29/083* (2013.01); *F05D 2230/52* (2013.01)

(58) Field of Classification Search
CPC ..... F04D 29/40; F04D 29/403; F04D 29/522; F01D 9/042; F01D 25/246
USPC ..... 417/423.4
See application file for complete search history.

(56) References Cited

U.S. PATENT DOCUMENTS 5,350,275 A * 9/1994 Ishimaru ..... F04D 19/042 415/200
6,019,581 A * 2/2000 von Schulz-Hausmann ..... F04D 29/5806 417/423.4
2001/0016160 A1* 8/2001 Ikegami ..... F04D 27/008 415/90
2009/0257889 A1* 10/2009 Shi ..... F04D 29/542 417/244

FOREIGN PATENT DOCUMENTS

JP 2003278691 A 10/2003
JP 2007002692 A 1/2007
JP 2011027049 A 2/2011
WO WO-2014045438 A1 * 3/2014 ..... F04D 19/042
WO 2014045438 A1 8/2016

OTHER PUBLICATIONS

PCT International Search Report dated Apr. 26, 2016 for PCT Application Serial No. PCT/JP2016/051421.
PCT International Written Opinion dated Apr. 26, 2016 for PCT Application Serial No. PCT/JP2016/051421.

* cited by examiner

ADAPTOR AND VACUUM PUMP

CROSS-REFERENCE OF RELATED APPLICATION

This Application is a Section 371 National Stage Application of International Application No. PCT/JP2016/051421, filed Jan. 19, 2016, which is incorporated by reference in its entirety and published as WO 2016/136331 A1 on Sep. 1, 2016 and which claims priority of Japanese Application No. 2015-035437, filed Feb. 25, 2015.

BACKGROUND OF THE INVENTION

This invention relates to an adapter and a vacuum pump using the adapter, and more particularly, to an adapter for using a base having the same shape regardless of a change in specifications, such as the dimensions and number of stages of rotor blades and stator blades, and a vacuum pump using the adapter.

A semiconductor manufacturing apparatus, a liquid crystal manufacturing apparatus, an electronic microscope, a surface analysis apparatus, a microfabrication apparatus, and the like are known as apparatuses configured to keep the inside thereof in vacuum by performing an exhausting process using a vacuum pump. A turbo-molecular pump is known as a vacuum pump used in those apparatuses. Performance (exhaust velocity and compression ratio) of the turbo-molecular pump is adjusted by changing the number of stages, length, and thickness of rotor blades and stator blades, the capacity of a housing accommodating the rotor blades and the stator blades, and the like. For example, as illustrated in FIG. 7, when the length dimensions of a rotor blade 4*a* and a stator blade 4*b* are increased in order to enhance the performance of a turbo-molecular pump 4 indicated by the solid lines, the radial dimension of a housing 4*c* also increases as indicated by the broken lines.

A turbo-molecular pump in which the outer diameter of a rotor blade on an outlet port side is smaller than the outer diameter of a rotor blade on an inlet port side is disclosed in Japanese Unexamined Patent Publication No. 2011-027049. A turbo-molecular pump in which a rotor blade on an outlet port side has a smaller diameter than that of a rotor blade on an inlet port side, and a clearance between spacer rings is larger than the thickness of a stator blade is disclosed in Japanese Patent No. 4749054.

The turbo-molecular pumps as described above have a problem in that cost is high because components need to be individually designed in order to respond to required specifications that are different for each apparatus such as a semiconductor manufacturing apparatus, and inventory management of the components becomes complicated.

The turbo-molecular pumps also have a problem in that it takes a long time to determine a failure that only occurs when particular components are combined because the turbo-molecular pumps are assembled by combining various types of components.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

This invention has been made in view of the problems of the related art as described above, and an object thereof is to provide a vacuum pump capable of responding to various changes in specifications at low cost.

This invention has been proposed in order to attain the object described above, and the invention according to claim 1 provides a vacuum pump, including: a base; a stator blade provided on the base in an axial direction of a rotor; a rotor blade that is integrally attached to the rotor; a housing that is formed in a cylindrical shape, and accommodates the stator blade and is integrally attached to the base, the vacuum pump further including an adapter that is replaceable depending on a type of the stator blade, the rotor blade, or the housing, and that is detachably mounted on the base and is configured to support the stator blade in the axial direction.

With this configuration, the shape of the adapter is changed so as to be capable of supporting the stator blade in accordance with a change in specifications of the vacuum pump, and the adapter is sandwiched between the base and the stator blade in the axial direction and fixed to the base, thereby enabling the base having the same shape to be applied to vacuum pumps having different specifications. As a result, costs for designing, manufacturing, and inventory management of the base may be reduced.

The invention according to claim 2 provides the vacuum pump according to claim 1, additionally having a configuration in which the adapter is formed in a circular ring shape.

This configuration enables the adapter to be easily mounted on the base by forming the adapter as a single component.

The invention according to claim 3 provides the vacuum pump according to claim 1 or 2, additionally having a configuration in which the adapter is formed to extend in a radial direction perpendicular to the axial direction.

This configuration enables the adapter to be easily mounted on the base by forming the adapter as a single component.

The invention according to claim 4 provides the vacuum pump according to any one of claims 1 to 3, additionally having a configuration in which the adapter is mounted on the base in a state in which movement of the adapter in a radial direction perpendicular to the axial direction is restricted.

This configuration enables the adapter to be easily mounted on the base because the adapter formed separately from the base is mounted on the base in a state in which the movement of the adapter in the radial direction is restricted.

The invention according to claim 5 provides the vacuum pump according to claim 4, additionally having a configuration in which the adapter is provided with an engaging portion capable of restricting the movement of the adapter by engaging with the base.

This configuration enables the adapter to be easily mounted on the base because the movement of the adapter in the radial direction may be restricted by simply engaging the engaging portion with the base.

The invention according to claim 6 provides the vacuum pump according to claim 5, additionally having a configuration in which an upper portion of the base is provided with a portion to be engaged capable of engaging with an engaging portion provided at a lower portion of the adapter.

This configuration enables the adapter to be easily mounted on the base because the movement of the adapter in the radial direction may be restricted by simply engaging the engaging portion with the portion to be engaged.

The invention according to claim 7 provides the vacuum pump according to any one of claims 1 to 6, additionally having a configuration in which the housing includes: a diameter expansion portion that is formed to expand in diameter from an upstream side to a downstream side in the axial direction; and a flange portion that is provided on an end portion of the diameter expansion portion on the downstream side and that has a bolt insertion hole formed therein in which a bolt capable of firmly connecting the diameter expansion portion and the base to each other is inserted.

With this configuration, the bolt hole is formed in the flange portion provided on the end portion of the diameter expansion portion on the downstream side, and hence even when the radial dimension of the diameter expansion portion increases or decreases depending on a change in specifications of the vacuum pump, the bolt configured to firmly connect the base and the flange portion to each other is positioned at a predetermined position, thus enabling the base having the same shape to be applied to vacuum pumps having different specifications.

The invention according to claim 8 provides the vacuum pump according to any one of claims 1 to 6, additionally having a configuration in which the housing includes a flange portion that expands outwardly in diameter from the housing toward a radial direction perpendicular to the axial direction and that has a bolt insertion hole formed therein in which a bolt capable of firmly connecting the housing and the base to each other is inserted.

With this configuration, the bolt hole is formed in the flange portion provided at a position extending outwardly from the housing, and hence even when the radial dimension of the housing increases or decreases depending on a change in specifications of the vacuum pump, the bolt configured to firmly connect the base and the flange portion to each other is positioned at a predetermined position, thus enabling the base having the same shape to be applied to vacuum pumps having different specifications.

The invention according to claim 9 provides the vacuum pump according to claim 7 or 8, additionally including a sealing means for sealing a space between the base and the flange portion.

Because the number of places for providing the sealing means is reduced by providing the sealing means between the base and the flange portion as compared to when the sealing means is provided to the adapter, this configuration enhances sealing properties of the vacuum pump and increases assembling accuracy of the pump as the number of places for providing the sealing means is reduced.

The invention according to claim 10 provides the vacuum pump according to claim 9, additionally having a configuration in which the sealing means is provided near the bolt insertion hole.

This configuration enhances the pump performance of the vacuum pump because external dimensions of the rotor blade and the stator blade may be set to be large.

The invention according to claim 11 provides an adapter which is used in the vacuum pump according to any one of claims 1 to 10.

With this configuration, the shape of the adapter is changed so as to be capable of supporting the stator blade depending on a change in specifications of the vacuum pump, and the adapter is sandwiched between the base and the stator blade in the axial direction and fixed to the base, thus enabling the base having the same shape to be applied to vacuum pumps having different specifications. As a result, costs for designing, manufacturing, and inventory management of the base may be reduced.

According to this invention, the base having the same shape can be applied regardless of a change in specifications of the vacuum pump. As a result, costs for designing, manufacturing, and inventory management of the base may be reduced.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

In order to attain the object of responding to various changes in specifications at low cost, this invention is achieved by providing a vacuum pump, including: a base; a stator blade provided on the base in an axial direction of a rotor; a rotor blade integrally attached to the rotor; a housing formed in a cylindrical shape, which accommodates the stator blade therein and is integrally attached to the base; and an adapter, which is replaceable depending on a type of one of the stator blade, the rotor blade, and the housing, is detachably mounted on the base, and is configured to support the stator blade in the axial direction.

In order to attain the object of responding to various changes in specifications at low cost, this invention is achieved by providing an adapter used in a vacuum pump including: a base; a stator blade provided on the base in an axial direction of a rotor; a rotor blade integrally attached to the rotor; and a housing formed in a cylindrical shape, which accommodates the stator blade therein and is integrally attached to the base, the adapter being replaceable depending on a type of one of the stator blade, the rotor blade, and the housing, being detachably mountable on the base, and being capable of supporting the stator blade in the axial direction.

Examples

Figure 1:
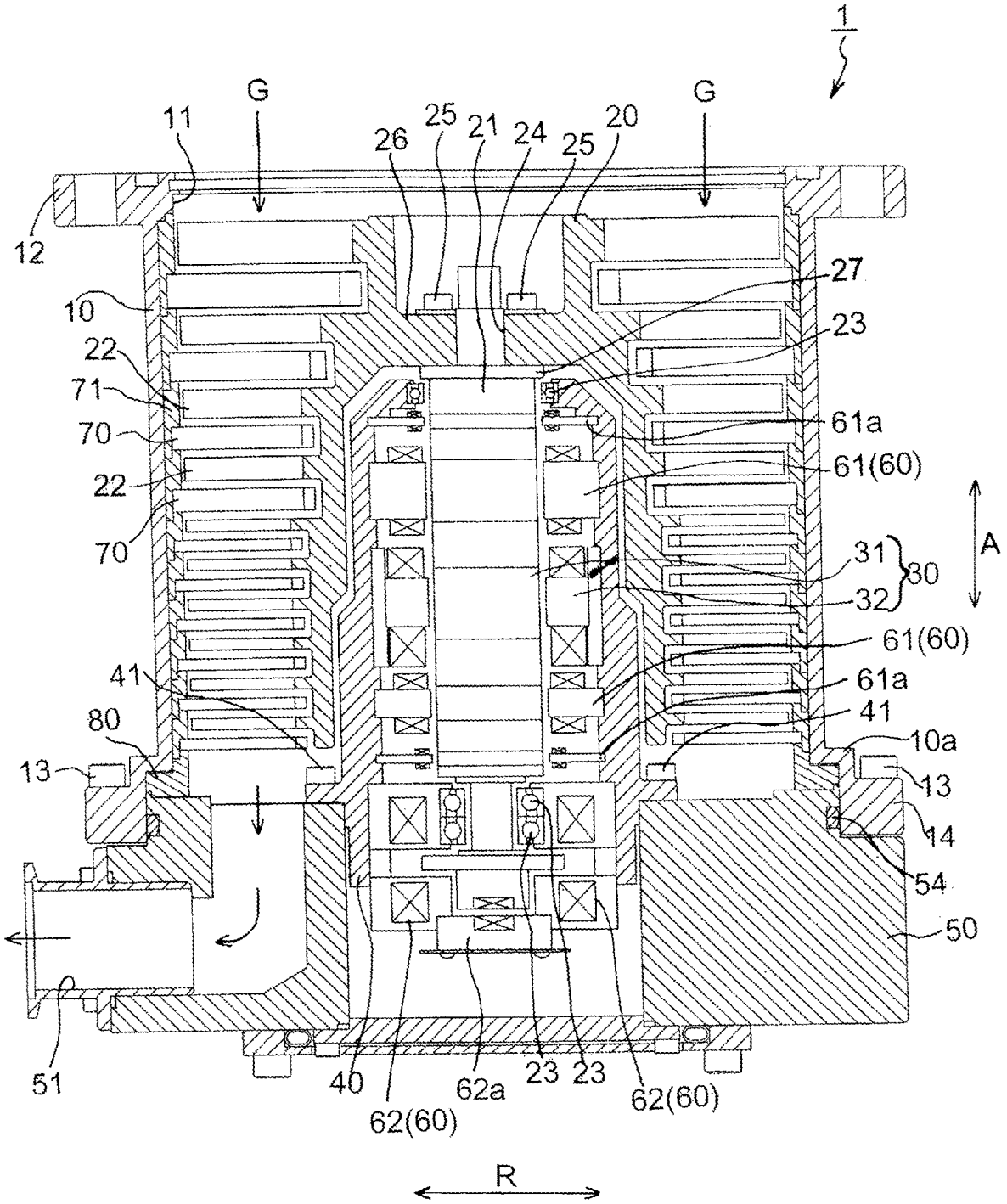
FIG. 1 is a vertical sectional view of a turbo-molecular pump according to Example 1 of this invention.
Figure 3:
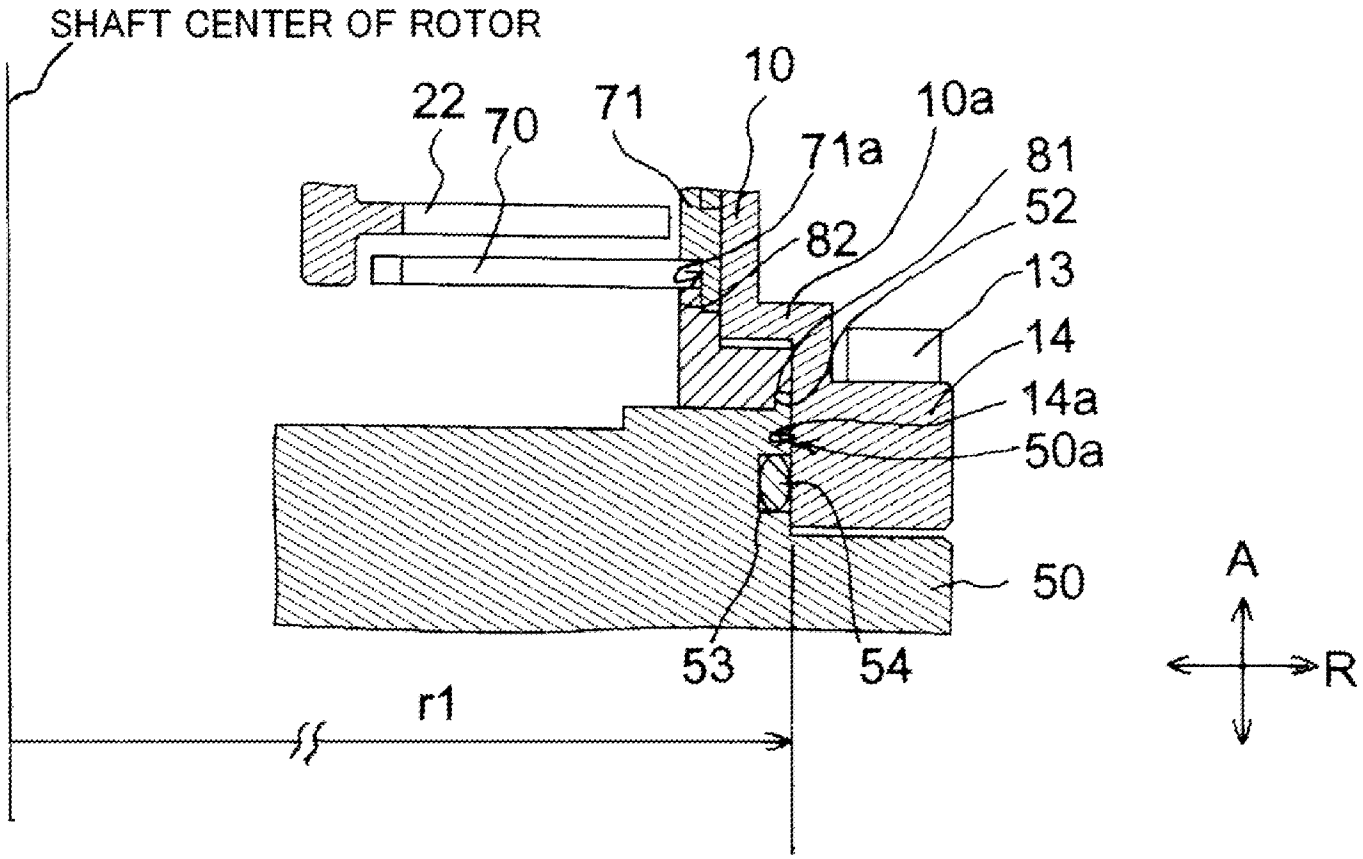
FIG. 3 is an enlarged sectional view of a main part of the turbo-molecular pump according to Example 1 of this invention.
Figure 4:
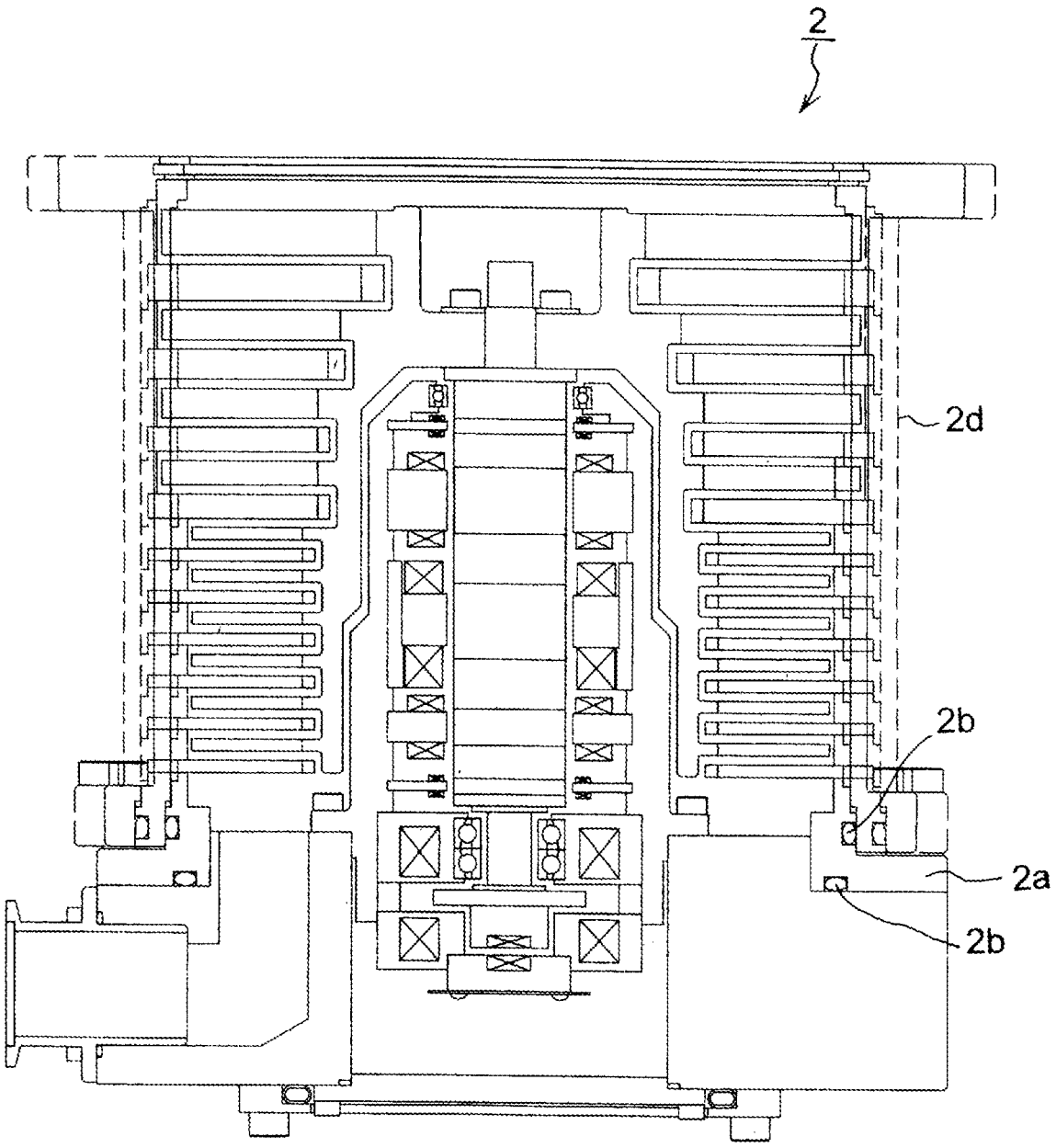
FIG. 4 is a schematic view of a turbo-molecular pump according to a comparative example of this invention for showing a change in dimensions of a housing in a turbo-molecular pump having different specifications, in which hatching is omitted in order to facilitate understanding.

A turbo-molecular pump 1 according to Example 1 of this invention is described below with reference to the drawings. In the description below, words such as "up" and "low" are used so that an upstream side of a direction in which exhaust gas G is exhausted is referred to as an "upper side" and a downstream side thereof is referred to as a "lower side", that is, an inlet port 11 side is referred to as the "upper side" and an outlet port 51 side is referred to as the "lower side" in an axial direction A described below. FIG. 1 is a vertical sectional view of the turbo-molecular pump 1 for illustrating Example 1 of this invention. FIG. 2A is a plan view of an adapter 80 in FIG. 1, and FIG. 2B is a sectional view taken along the line A-A in FIG. 2A. FIG. 3 is an enlarged view of a main part in FIG. 1. FIG. 4 is a schematic view of a turbo-molecular pump 2 according to a comparative example of this invention.

The turbo-molecular pump 1 includes a housing 10, a rotor 20 including a rotor shaft 21 rotatably supported in the housing 10, a drive motor 30 configured to rotate the rotor shaft 21, and a stator column 40 accommodating a part of the rotor shaft 21 and the drive motor 30.

The housing 10 is formed in a cylindrical shape. A gas inlet port 11 is formed in an upper end of the housing 10. The housing 10 is attached to a vacuum vessel such as a chamber of a semiconductor manufacturing apparatus (not shown) through an upper flange 12. The gas inlet port 11 is connected to the vacuum vessel. The housing 10 is fixedly mounted on a base 50 through a bolt 13.

The rotor 20 includes the rotor shaft 21, and rotor blades 22 that are fixed on an upper portion of the rotor shaft 21 and are concentrically juxtaposed about a shaft center of the rotor shaft 21. In this example, ten stages of rotor blades 22 are provided.

The rotor blades 22 are formed of blades each inclined by a predetermined angle, and are formed integrally on an outer peripheral surface of an upper portion of the rotor 20. A plurality of rotor blades 22 are radially provided about an axis of the rotor 20.

The rotor shaft 21 is held by a magnetic bearing 60 without any contact. The magnetic bearing 60 includes a radial electromagnet 61 and an axial electromagnet 62. The radial electromagnet 61 and the axial electromagnet 62 are connected to a control unit (not shown).

The control unit is configured to control excitation currents of the radial electromagnet 61 and the axial electromagnet 62 on the basis of detected values of a radial displacement sensor 61*a* and an axial displacement sensor 62*a*, so that the rotor shaft 21 is held in a floating state at a predetermined position.

An upper portion and a lower portion of the rotor shaft 21 are inserted in touchdown bearings 23. When the rotor shaft 21 is out of control, the rotor shaft 21 rotating at high speed comes into contact with the touchdown bearings 23, to thereby prevent damage on the vacuum pump 1.

The rotor 20 is integrally attached to the rotor shaft 21 by inserting the upper portion of the rotor shaft 21 in a boss hole 24 and then inserting a bolt 25 in a rotor flange 26 to screw the bolt 25 in a shaft flange 27. In the description below, an axial direction of the rotor shaft 21 is referred to as an "axial direction A" and a radial direction of the rotor shaft 21 is referred to as a "radial direction R".

The drive motor 30 includes a rotator 31 provided around an outer periphery of the rotor shaft 21, and a stator 32 provided so as to surround the rotator 31. The stator 32 is connected to the control unit (not shown) described above, and the control unit is configured to control the rotation of the rotor 20.

The stator column 40 is fixedly mounted on the base 50 through a bolt 41.

A stator blade 70 is provided between the rotor blades 22 and 22. That is, the rotor blades 22 and the stator blades 70 are arranged in an alternating manner in multiple stages along the axial direction A. In this example, ten stages of stator blades 70 are provided.

The stator blades 70 are annularly formed, and include blades inclined in a direction opposite to the rotor blades 22 and rings connected to both ends of the blades. The stator blades 70 are sandwiched by spacers 71 provided on an inner peripheral surface of the housing 10 in a stacked state and are positioned in the axial direction A. The stator blades 70 also have a plurality of blades radially provided about the axis of the rotor 20.

The lengths of the blades of the rotor blades 22 and the stator blades 70 are set to gradually shorten from the upper side to the lower side in the axial direction A.

The gas outlet port 51 is formed in the base 50 on a lateral side of a lower portion thereof. The gas outlet port 51 is connected to an auxiliary pump (not shown) to communicate thereto. The turbo-molecular pump 1 is configured to transfer gas sucked from the gas inlet port 11 from the upper side to the lower side in the axial direction A by rotating the rotor blade 22, to thereby exhaust the gas from the gas outlet port 51 to the outside.

The stator blade 70 on the lowest stage is mounted on the base 50 through the adapter 80. Specifically, a base end portion of the stator blade 70 is sandwiched between a supporting portion 82 of the adapter 80 described later and the spacer 71, to be supported in the axial direction A.

Figure 2:
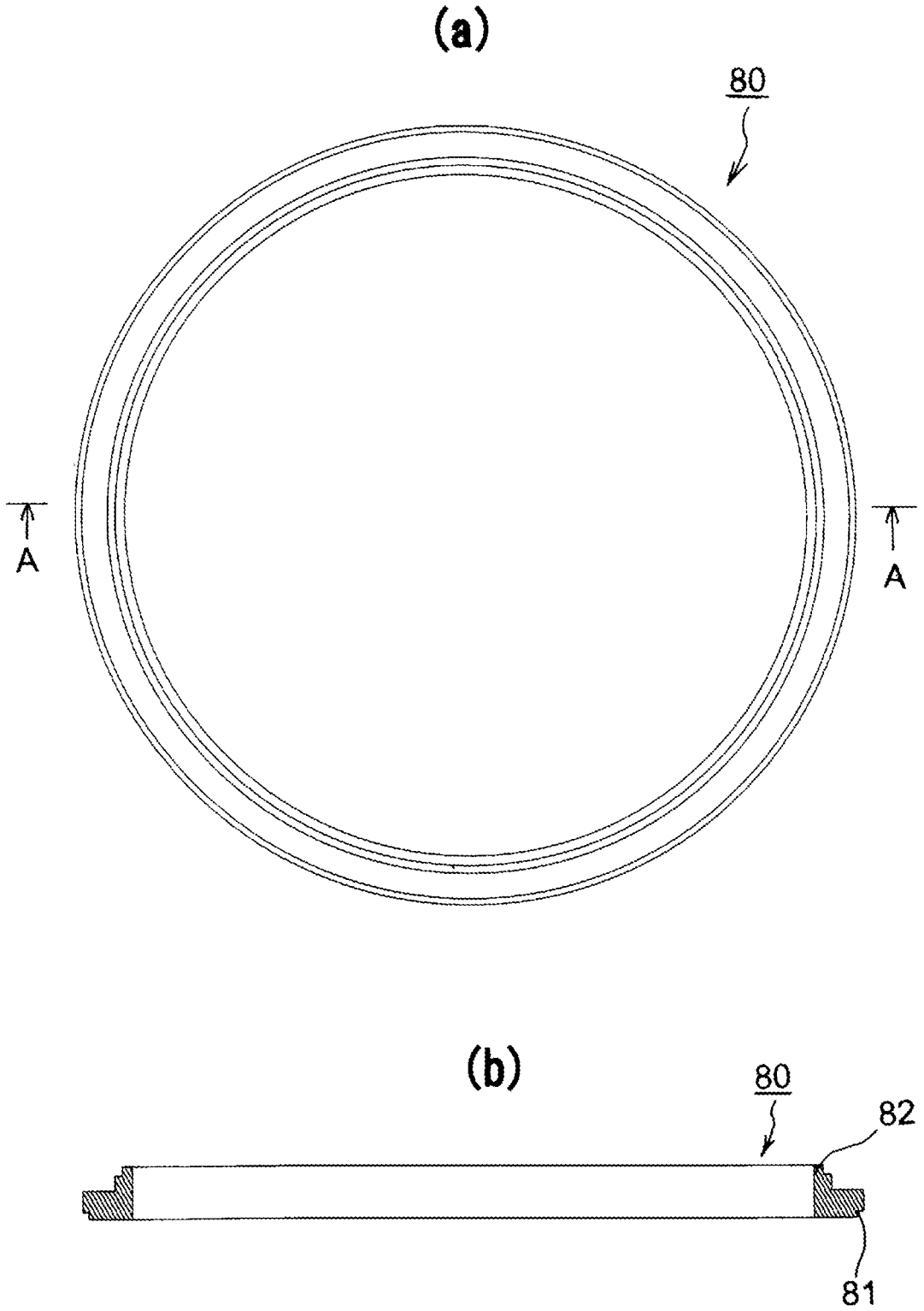
FIG. 2A is a plan view and FIG. 2B is a vertical sectional view of an adapter illustrated in FIG. 1.

The adapter 80 is formed as a circular ring as illustrated in FIG. 2. The adapter 80 has an L-shaped cross section, and the lower portion facing the base 50 expands in diameter (extends) in the radial direction R as compared to the upper portion. The lower portion of the adapter 80 is in contact with the base 50. The shape of the adapter 80 is replaceable depending on the type of the stator blade 70, the rotor blade 22, or the housing 10. That is, the adapter 80 is freely changeable depending on the number of stages or the size of the stator blades 70 and the rotor blades 22, the inner diameter dimension of the housing 10, and the like. The adapter 80 is formed separately from the base 50, and is detachably mounted on the base 50. The adapter 80 may be easily mounted on the base 50 by forming the adapter 80 as a single component formed as the circular ring.

An engaging portion 81 is inwardly recessed in a lower outer peripheral edge of the adapter 80. The supporting portion 82 is formed on an upper outer peripheral edge of the adapter 80 so as to protrude therefrom.

The adapter 80 is attached to the base 50 in a state in which movement of the adapter 80 in the radial direction R is restricted. Specifically, as illustrated in FIG. 3, the engaging portion 81 is engaged with a portion to be engaged 52 formed on an upper surface of the base 50 so as to protrude therefrom. The supporting portion 82 is in contact with an inner peripheral surface 71*a* of the spacer 71. As a result, the adapter 80 is mounted on the base 50 in a state in which the movement of the adapter 80 in the radial direction R is restricted and the center of the base 50 and the center of the adapter 80 match with each other. The adapter 80 and the housing 10 have a small clearance secured therebetween.

The base 50 has a bolt hole (not shown) in which the bolt 13 may be screwed. The bolt hole in the base 50 and a bolt insertion hole (not shown) in the housing 10 are formed at predetermined positions regardless of whether there is a change in specifications of the turbo-molecular pump 1. The bolt insertion hole in the housing 10 is formed in the lower flange 14, which is a flange portion provided on a lower edge portion of a diameter expansion portion 10*a* that is formed by expanding the outer diameter of the housing 10 from a middle portion thereof into a step shape. An inner diameter of an inner peripheral surface 14*a* of the lower flange 14 and an outer diameter of an outer peripheral surface 50*a* of the base 50 facing the lower flange 14 are maintained to have substantially equal values r1 regardless of whether there is a change in specifications of the turbo-molecular pump 1. The cross-sectional shape of the diameter expansion portion 10*a* is not limited to be a step shape and may be a tapered shape, for example. The diameter expansion portion 10*a* is not limited to be provided on the housing 10 and may be formed by expanding a part of the flange portion 14 in diameter.

An O ring 54 is provided as a sealing means for sealing the clearance between the base 50 and the lower flange 14. The O ring 54 is accommodated in a groove portion 53 inwardly recessed in the outer peripheral surface 50*a* of the base 50. It is preferred that the O ring 54 be placed near the bolt insertion hole. "Near the bolt insertion hole" means a place on the inner side of the bolt insertion hole in the radial direction R that is as close as possible to the outer side thereof. Therefore, the rotor blade 22 and the stator blade 70 may each be secured to have a large outer diameter dimension.

As a result, whereas the turbo-molecular pump 2 according to the comparative example of this invention illustrated in FIG. 4, for example, has a sealing means 2*b* provided in an adapter 2*a* and thus a space between the adapter 2*a* and a base 2*c* and a space between the adapter 2*a* and a housing 2*d* need to be sealed, this invention only needs to seal a space between the base 50 and the housing 10. Thus, sealing properties of the turbo-molecular pump 1 may be easily secured and the turbo-molecular pump 1 may be efficiently assembled. In this invention, the position of the O ring 54 provided between the housing 10 and the base 50 in the radial direction R may be unified to the predetermined value r1.

Figure 5:
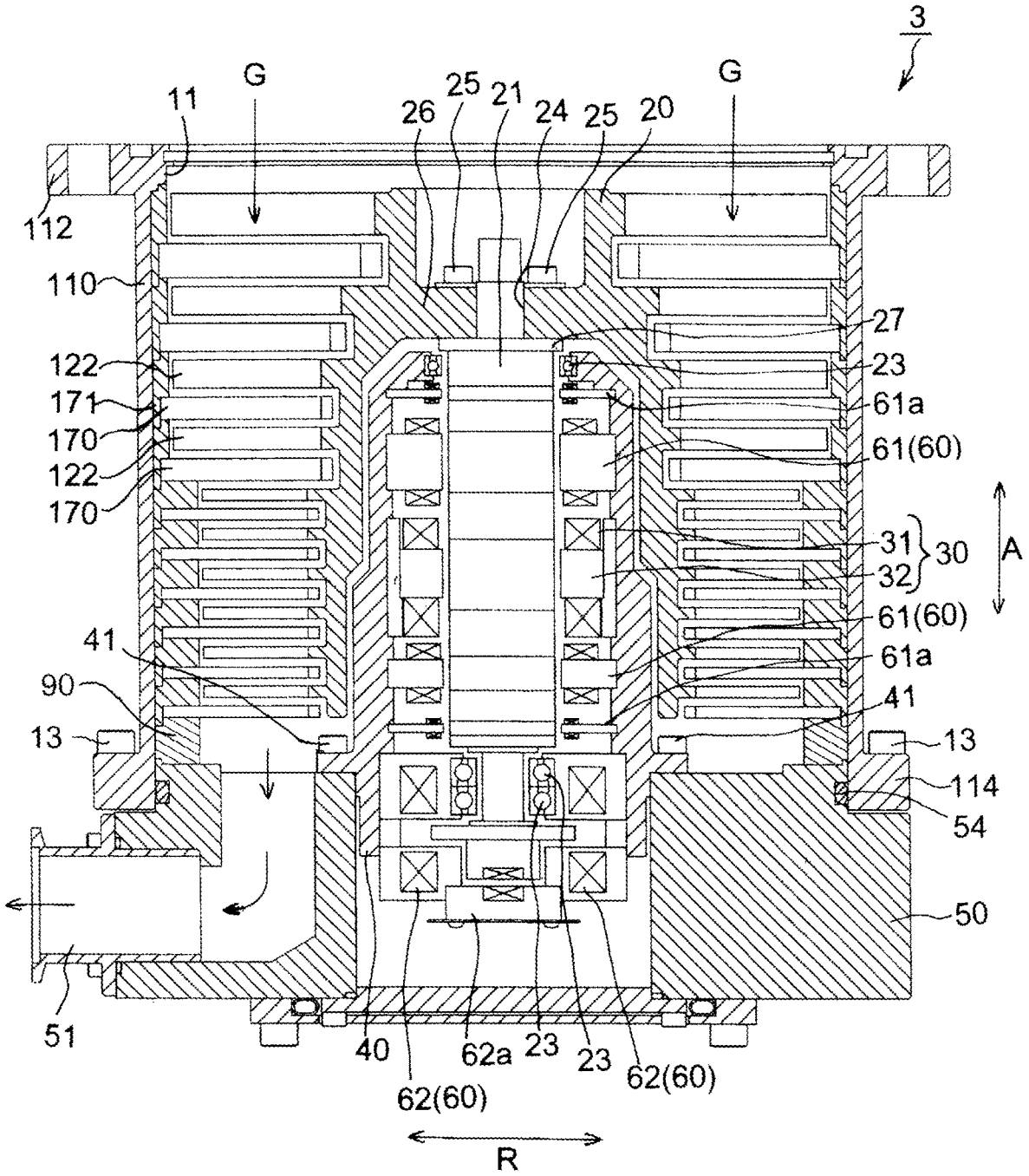
FIG. 5 is a vertical sectional view of a turbo-molecular pump according to Example 2 of this invention.
Figure 6:
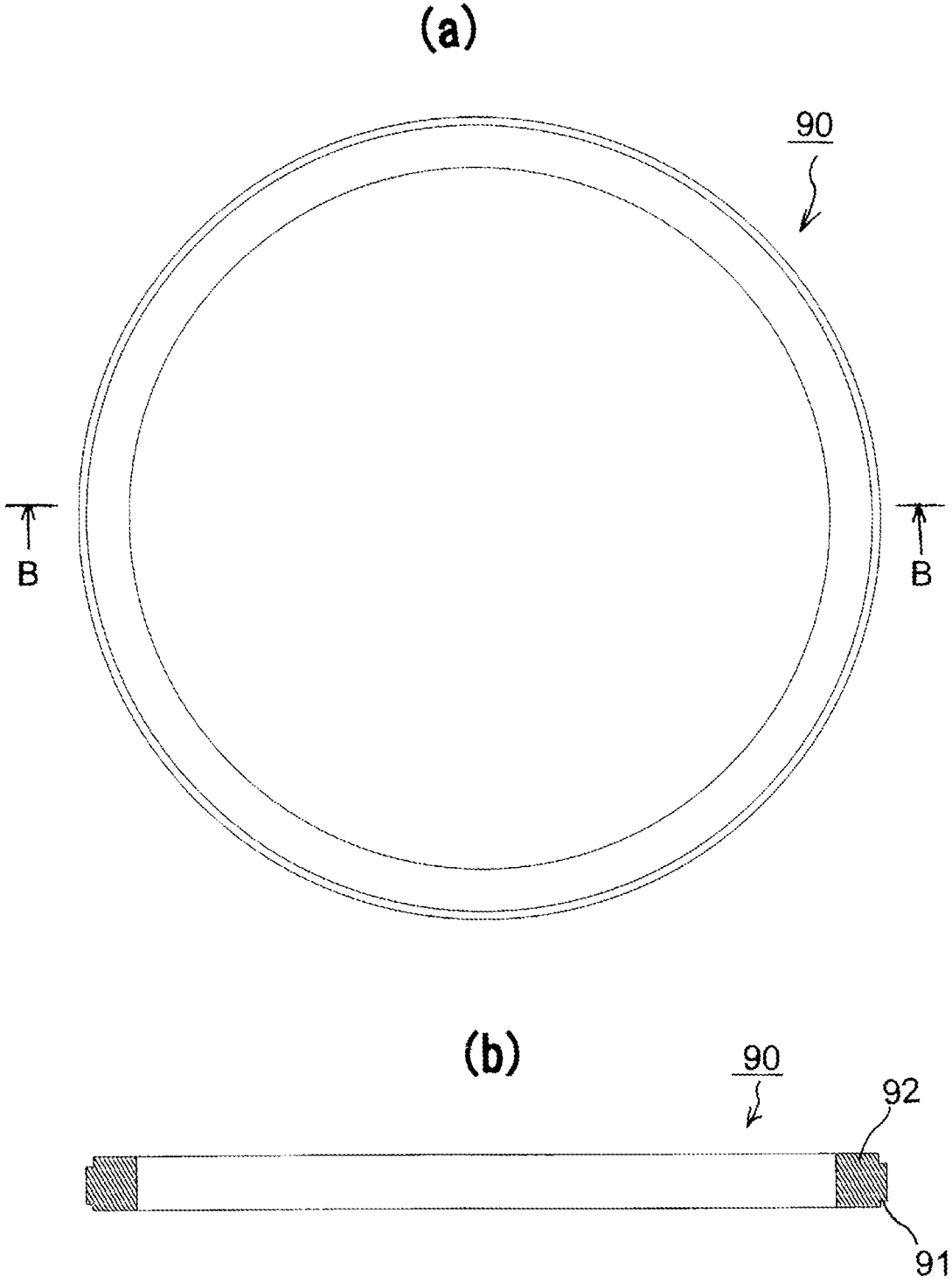
FIG. 6A is a plan view and FIG. 6B is a vertical sectional view of an adapter illustrated in FIG. 5.
Figure 7:
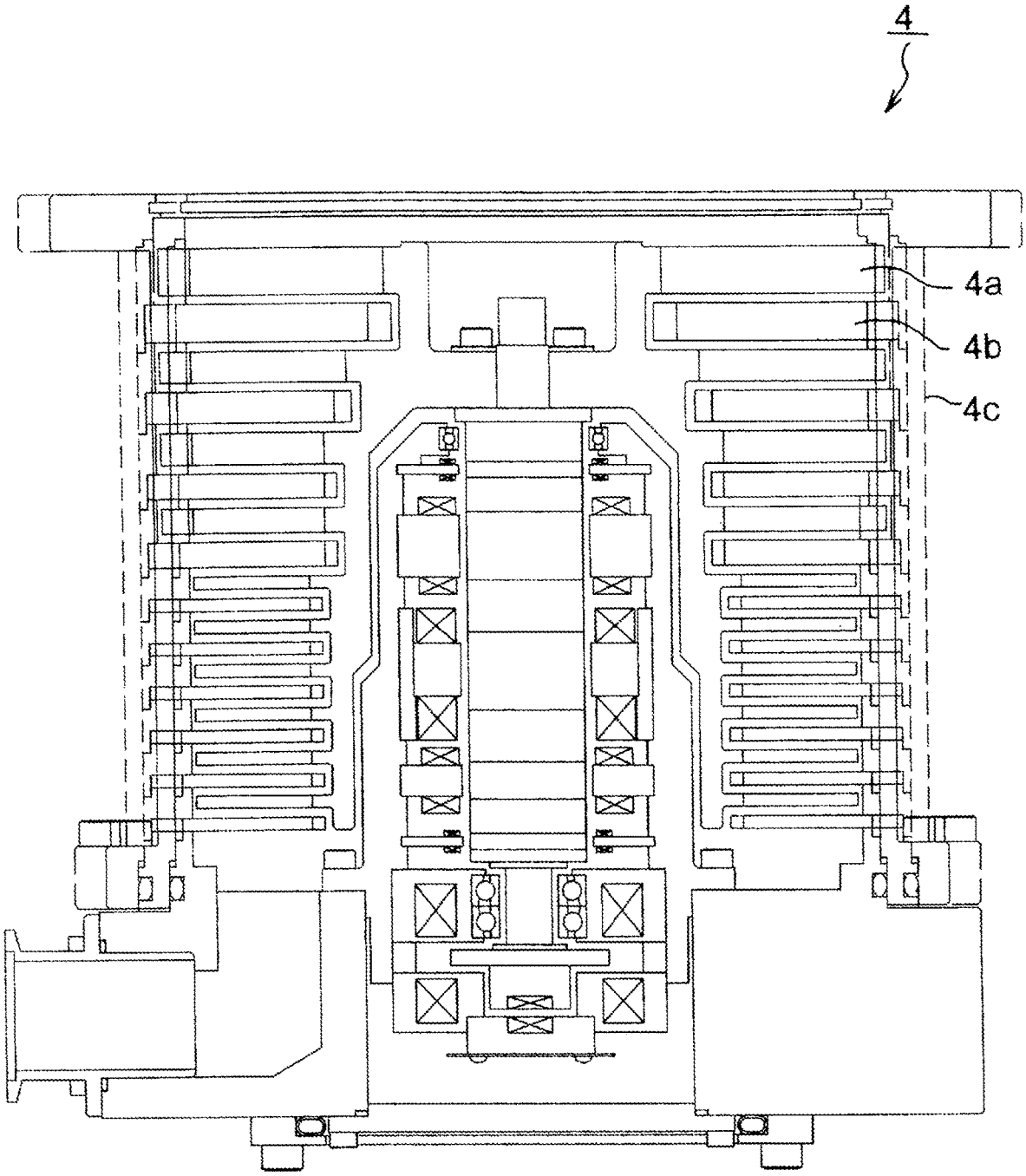
FIG. 7 is a schematic view of a turbo-molecular pump of the related art for showing a change in dimensions of a housing in a sectional view of the turbo-molecular pump having different specifications, in which hatching is omitted in order to facilitate understanding.

Next, a turbo-molecular pump 3 according to Example 2 of this invention is described with reference to the drawings. FIG. 5 is a vertical sectional view illustrating the turbo-molecular pump 3. FIG. 6A is a plan view of an adapter 90 in FIG. 5 and FIG. 6B is a sectional view taken along the line B-B in FIG. 6A. In the turbo-molecular pump 3 according to Example 2, the upper flange, the rotor blade, the stator blade, and the spacer each have a larger outer diameter, the shape around the lower flange is different, and the specific structure of the adapter is different as compared to the turbo-molecular pump 1 according to Example 1 described above. Thus, components that are in common to the turbo-molecular pump according to Example 1 are denoted with the same reference numerals and overlapping descriptions thereof are omitted. The upper flange, the rotor blade, the stator blade, the spacer, and the lower flange are denoted with numerals in the one hundreds and overlapping descriptions thereof are omitted. The configurations of the adapter 90 according to Example 2 that are in common to the adapter 80 according to Example 1 are denoted with numerals in the nineties and overlapping descriptions thereof are omitted.

The adapter 90 is a circular ring having a substantially rectangular cross section. As compared to the adapter 80 according to Example 1 described above, the adapter 90 is formed thicker in the radial direction R to support a base end side of a stator blade 170 of the lowest stage across a wide area. The diameter of an engaging portion 91 is substantially the same as the diameter of the engaging portion 81. The outer diameter of a housing 110 is not expanded outward toward the radial direction R from a middle portion thereof in the axial direction A to form a step shape. Therefore, even if a rotor blade 122 and the stator blade 170 each have an outer diameter larger than that in Example 1, positioning may be reliably performed and the same base 50 may be used. Even if a large stator blade 170 extending in the outer diameter side is provided in the turbo-molecular pump 2 in which the outer diameter of the rotor blade 122 on the outlet port 51 side is smaller than the outer diameter of a rotor blade 112 on the inlet port 11 side, positioning may be reliably performed.

As described above, in this invention, the shape of the adapter is changed so as to be capable of supporting the stator blade depending on a change in specifications of the turbo-molecular pump (that is, the length of the portion of the adapter where the diameter expands in the radial direction R is changed), the adapter formed separately from the base is mounted on the base in a state in which the movement of the adapter in the radial direction R is restricted, and the adapter is sandwiched between the base and the stator blade in the axial direction and fixed to the base. Thus, the base having the same shape may be applied to turbo-molecular pumps having different specifications. As a result, costs for designing, manufacturing, and inventory management of the base may be reduced.

The cross-sectional shape of the adapter is not limited to Examples described above. The adapter may be any shape as long as the adapter is capable of supporting the stator blade, and may be formed to have a cross-sectional shape of, for example, a trapezoid, an I-shape, or the like besides the cross-sectional shapes described above.

The engaging portion and the portion to be engaged are not limited to be a recessed engaging portion and a protruding portion to be engaged, and may be a protruding engaging portion and a recessed portion to be engaged.

The engaging portion and the portion to be engaged may be provided at any place in the radial direction R, and are not limited to be provided at the outer peripheral edge of the adapter and the outer peripheral edge of the base as described above. The engaging portion and the portion to be engaged may be provided at the inner side of the outer peripheral edge of the adapter and the outer peripheral edge of the base in the radial direction R.

This invention may also be applied to an exhaust gas treatment apparatus used other than in a semiconductor manufacturing treatment process. Needless to say, the vacuum pump according to this invention may not only be applied to an all-blade vacuum pump formed of only the turbo-molecular pump but also to a compound vacuum pump formed of the turbo-molecular pump and a thread groove pump.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a base that is formed in a cylindrical shape;

a stator blade that is provided above the base in an axial direction of a rotor;

a plurality of stator blade spacers;

a plurality of rotor blades that are integrally attached to the rotor and have a same outer diameter;

a housing that is formed in a cylindrical shape from a first axial position at a rotor blade at an inlet side end of the rotor among the plurality of rotor blades to a second axial position at the stator blade, accommodates the stator blade therein, has an inlet port, is provided on an outer peripheral side of the stator blade so as to be peripherally apart from the outer peripheral side of the stator blade and is integrally attached to the base; and a sealing means sealing a clearance between the base and the housing, the vacuum pump further comprising:

an adapter that is replaceable depending on a type of the stator blade, the plurality of rotor blades, or the housing, and that is detachably mounted on the base and is configured to support and contact the stator blade in the axial direction, wherein the adapter has a radial direction positioning surface contacting with a side surface of the base, an inner circumferential surface of the housing has a region having a diameter smaller than an inner diameter of the sealing means, and all of the plurality of stator blade spacers are provided in a vacuum region, the housing has an inner peripheral side surface at an outer peripheral side of at least one of the plurality of stator blade spacers with an inner diameter that is smaller than a diameter of an outer periphery of the adapter, and the housing has an outer periphery at the outer peripheral side of the at least one of the plurality of stator blade spacers with a diameter that is smaller than the diameter of the outer periphery of the adapter.

2. The vacuum pump according to claim 1, wherein the adapter is formed in a circular ring shape.

3. The vacuum pump according to claim 1, wherein the adapter is formed to extend in a radial direction perpendicular to the axial direction.

4. The vacuum pump according to claim 1, wherein the adapter is mounted on the base in a state in which movement of the adapter in a radial direction perpendicular to the axial direction is restricted.

5. The vacuum pump according to claim 4, wherein an upper portion of the base is provided with a portion to be engaged capable of engaging with the radial direction positioning surface provided at a lower portion of the adapter.

6. The vacuum pump according to claim 1, wherein the housing comprises:

a diameter expansion portion that is formed to expand in diameter from an upstream side to a downstream side in the axial direction; and a flange portion that is provided on an end portion of the diameter expansion portion on the downstream side and that has a bolt insertion hole formed therein in which a bolt capable of firmly connecting the diameter expansion portion and the base to each other is inserted.

7. The vacuum pump according to claim 1, wherein the housing comprises a flange portion that expands outwardly in diameter from the housing toward a radial direction perpendicular to the axial direction and that has a bolt insertion hole formed therein in which a bolt capable of firmly connecting the housing and the base to each other is inserted.

8. The vacuum pump according to claim 6, wherein the sealing means seals a space between the base and the flange portion.

9. The vacuum pump according to claim 8, wherein the sealing means is provided on the inner side of the bolt insertion hole in a radial direction that is as close as possible to an outer side thereof.

10. The vacuum pump according to claim 7, wherein the sealing means seals a space between the base and the flange portion.

11. The vacuum pump according to claim 10, wherein the sealing means is provided on the inner side of the bolt insertion hole in a radial direction that is as close as possible to an outer side thereof.

* * * * *